United States Patent [19]

Dickey, Jr. et al.

[11] 4,317,785

[45] Mar. 2, 1982

[54] WATER COOLING TOWER HAVING COMBINATION SPLASH AND FILM FILL STRUCTURE

[75] Inventors: Joe B. Dickey, Jr., Fairway, Kans.; Ivan F. Kuharic, Kansas City, Mo.; Paul A. Lindahl, Jr., Shawnee Mission, Kans.

[73] Assignee: The Marley Company, Mission, Kans.

[21] Appl. No.: 237,863

[22] Filed: Feb. 20, 1981

[51] Int. Cl.[3] ..... B01F 3/04

[52] U.S. Cl. ..... 261/111; 261/112; 261/DIG. 11

[58] Field of Search ..... 261/109–112, 261/DIG. 11, DIG. 77

[56] References Cited

U.S. PATENT DOCUMENTS

| | | | |
|---|---|---|---|
| 2,615,700 | 10/1952 | Dixon | 261/109 X |
| 3,290,025 | 12/1966 | Engalitcheff, Jr. | 261/110 X |
| 3,318,586 | 5/1967 | Meredith | 261/109 X |
| 3,617,036 | 11/1971 | Brown | 261/111 |
| 3,733,063 | 5/1973 | Loetel et al. | 261/112 |
| 3,917,764 | 11/1975 | Phelps | 261/111 |
| 3,983,190 | 9/1976 | Norback | 261/DIG. 11 |

FOREIGN PATENT DOCUMENTS

| | | | |
|---|---|---|---|
| 36-31463 | 11/1961 | Japan . | |
| 38-255684 | 7/1963 | Japan . | |
| 40-376 | 1/1965 | Japan . | |
| 40-18134 | 6/1965 | Japan . | |
| 40-22621 | 8/1965 | Japan . | |
| 718687 | 2/1980 | U.S.S.R. | 261/109 |

*Primary Examiner*—Richard L. Chiesa

*Attorney, Agent, or Firm*—Schmidt, Johnson, Hovey & Williams

[57] ABSTRACT

An improved, high efficiency, combination fill assembly for crossflow cooling towers is provided which employs a strategically located, multiple sheet film fill section in conjunction with splash-type fill to maximize tower performance with a minimum tower height, pumping head requirements, and pressure drop across the assembly. In preferred forms, the fill includes a film fill section presenting substantially separate air and water entrance and exit faces, along with structure above the upper water entrance face thereof for dispersing water and inhibiting exiting of cooling air out of the water entrance face; in this fashion "short circuiting" of cooling air is inhibited, and the inertia of airflow is thereby maintained in the desirable crossflowing direction for enhanced water cooling. Separate film packs cooperatively define the overall film fill section, and the packs are advantageously arranged in an inwardly staggered relationship, with the uppermost pack being outermost, i.e., closest to the air entrance face of the fill assembly. Splash fill is employed in the regions of the overall assembly free of film fill packs.

7 Claims, 7 Drawing Figures

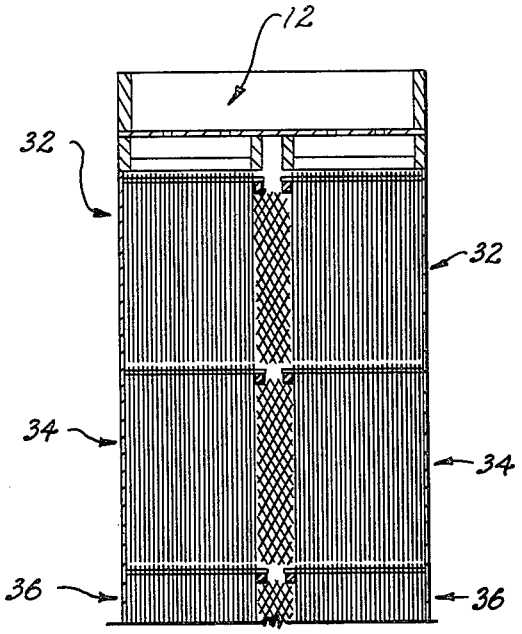
Fig. 4.
Fig. 5.
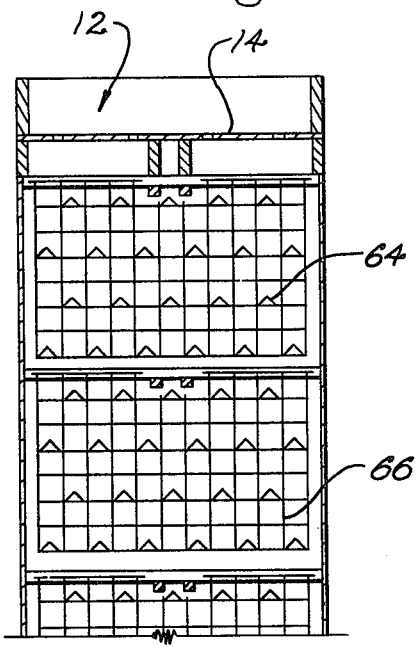
Fig. 6.
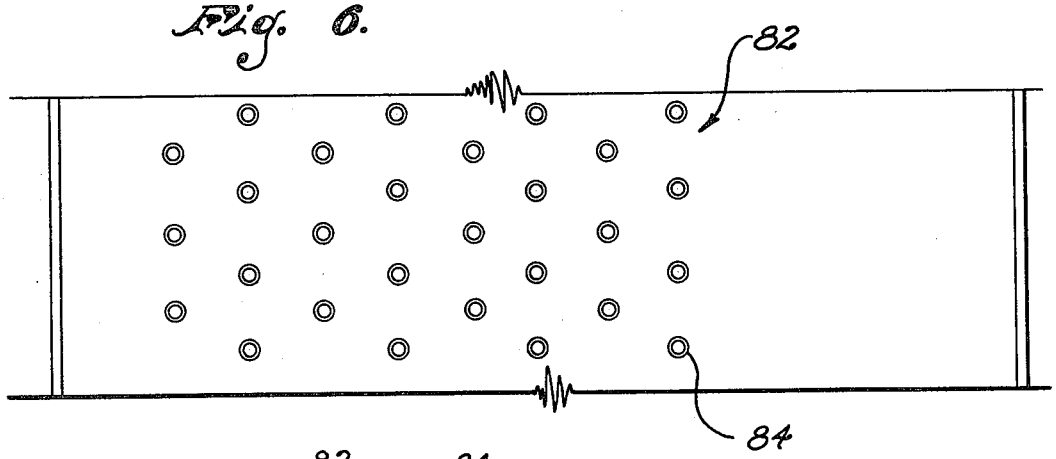
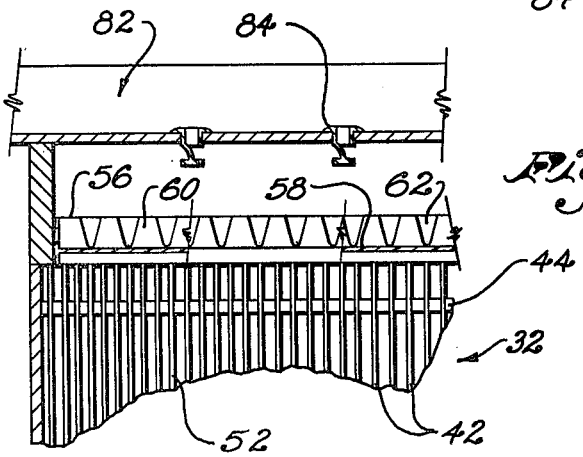
Fig. 7.

WATER COOLING TOWER HAVING COMBINATION SPLASH AND FILM FILL STRUCTURE

BACKGROUND OF THE INVENTION

1. Field of the Invention

The present invention is broadly concerned with a high efficiency fill assembly designed for use in crossflow water cooling towers and which makes optimum use of the desirable qualities of both film and splash-type fill components. More particularly, it is concerned with such a combination fill assembly wherein the more expensive and effective film fill portions are strategically located within the overall assembly for maximum cooling effect, whereas the splash components are situated throughout the remainder of the overall assembly.

2. Description of the Prior Art

Crossflow water cooling towers are today in widespread use and generally include an upper hot water distribution basin for receiving and distributing quantities of initially hot water, along with a fill structure beneath the basin for even distribution of the descending, initially hot water. Means such as powered fans or a hyperbolic stack are also provided, in order to draw ambient-derived cooling air currents through the fill structure in crossflowing, intersecting, heat exchanging relationship with the descending water. Cooled water is then collected in an underlying basin, whereas hot, moist air is discharged to the atmosphere.

Considerable research has been conducted in the past in connection with all aspects of crossflow cooling towers, and particularly the fill assemblies thereof. Thus, various varieties of splash-type fills have been proposed, which in general consist of elongated bars of specific configuration for dispersing descending hot water. Another type of fill heretofore in use is composed of a series of thin, opposed sheets formed of synthetic resin materials. Such fills are designed such that the descending water passes along the sheets in a film, and thus such fills have come to be known as "film fills." Generally speaking, film fills are significantly more efficient than splash-type fills, i.e., they give an enhanced cooling effect as compared with splash bar assemblies. However, film fills are much more expensive than splash units, and for this reason have not totally supplanted the latter.

U.S. Pat. No. 3,917,764 describes a combination fill assembly, i.e., one which employs both film fill sections and splash bars. However, the film assembly disclosed in the '764 patent is deemed deficient in a number of important respects. First, the film fill packs employed are oriented in the manner of a counterflow fill. That is to say, the air entrance faces of the film fill packs are coincident with the water exit faces, and correspondingly the air exit faces are coincident with the water entrance faces thereof. This orientation of the film fill packs leads to significant airflow disruptions and a tendency for the air to "short circuit", or travel in a diagonal pattern upwardly through the fill assembly. This in turn significantly reduces cooling efficiency.

SUMMARY OF THE INVENTION

The present invention is concerned with a combination fill assembly wherein the effectiveness of the more expensive and efficient film fill portions is maximized, both in terms of the position of such a film-type section, as well as its construction. The film fill section is of the crossflow type, with separate, opposed, upper and lower water entrance and exit faces, and correspondingly separate, opposed, outboard and inboard air entrance and exit faces.

The combination fill assembly of the invention includes a fill section having a series of spaced, opposed, face-to-face fill sheets which cooperatively present the separate water and air entrance and exit faces enumerated, with all of the respective faces being substantially separate. Further, water distribution and airflow restricting means are provided above the water entrance face of the film fill section for dispersing water prior to entrance thereof into the film fill section, and for inhibiting exit flow of air currents traveling through the film fill section out of the upper water entrance face. Finally, the overall fill assembly includes a splash fill section located in side-by-side relationship to the film fill section and includes a plurality of splash bars for dispersing quantities of descending water.

In preferred forms, the film fill section is defined by a plurality of film fill packs, which are oriented in a progressively inwardly staggered pattern, with the uppermost pack being outermost, or adjacent the air inlet of the tower. The respective film fill packs can be oriented in a point-to-point catercorner relationship, or more preferably such that the air exit of each pack is inboard of the air entrance portion of the next adjacent pack.

Additionally, the water distribution and airflow restricting means preferably is in the form of a plurality of side-by-side, elongated, water overflow troughs each having an imperforate bottom and notched, upright sidewalls for overflow of water onto the underlying film fill.

The overall design of the fill assembly thus assures that ambient-derived air currents pass through the assembly in a generally horizontal, crossflowing pattern. Provision of the overlapping, staggered film fill packs, in conjunction with the airflow restriction elements thereabove, assures that the inertia of airflow through the fill assembly is maintained in the desired crossflowing direction.

BRIEF DESCRIPTION OF THE DRAWINGS

FIG. 4 is a fragmentary end view illustrating a pair of side-by-side film fill packs, with a bottom supported auxiliary water cooling film fill spacer bundle between the film fill packs;

FIG. 5 is a fragmentary end view in partial vertical section illustrating the orientation of the splash fill components of the assembly depicted in FIG. 1;

FIG. 6 is a fragmentary top view illustrating a hot water distribution basin useful in conjunction with the fill assembly hereof; and FIG. 7 is a fragmentary view in partial vertical section illustrating a portion of the basin depicted in FIG. 6, along with an underlying film fill pack, with the latter being equipped with notched trough water distribution and airflow restricting means above the upper water entrance face of the pack.

DESCRIPTION OF THE PREFERRED EMBODIMENTS

Figure 1:
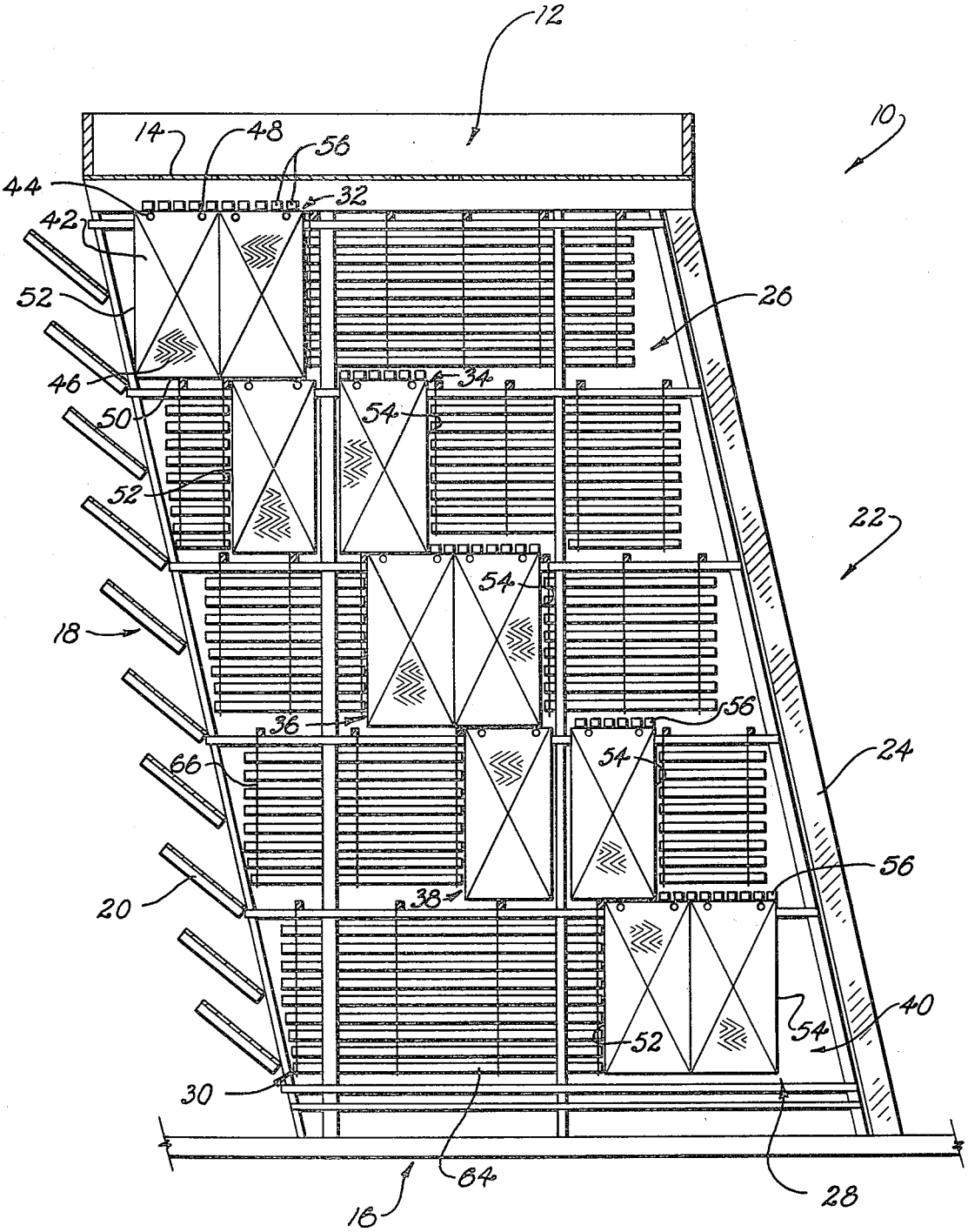
FIG. 1 is an essentially schematic vertical sectional view illustrating a combination film and splash-type fill assembly in accordance with the invention, located within a cooling tower.

Turning now to the drawings, a water cooling tower 10 is illustrated in FIG. 1. The tower 10 includes the usual upper hot water distirbution basin 12 having an apertured floor 14, as well as an underlying cold water collection basin 16. The outboard air entrance face 18 of the tower 10 is equipped with a plurality of obliquely oriented, superposed louvers 20, whereas the air exit face 22 of the tower is provided with the usual drift eliminator 24 for removing entrained water particles from the air passing therethrough.

A combination fill assembly broadly referred to by the numeral 26 is located between the basins 12 and 16, and the faces 18 and 22. Broadly speaking, the assembly 26 is designed for receiving and dispersing quantities of descending, initially hot water from basin 12, and for causing currents of crossflowing, ambient-derived cooling air drawn through the assembly to come into intersecting, thermal interchange relationship with the descending hot water. Again generally speaking, the overall fill assembly 26 is made up of obliquely oriented film fill sections referred to by the numeral 28, as well as splash fill sections 30.

In more detail, the film fill sections 28 are composed of a plurality, here five, of film fill packs, 32–40. The packs extend the full width of the air entrance face 18, or in the case of a circular tower, a continuous circular pattern at respective vertical levels. Each pack 32–40 is essentially identical, and is composed of a plurality of face-to-face fill sheets 42 (see FIG. 7) which are positioned in aligned, spaced apart relationship and supported by transversely extending pipe elements 44. The respective sheets 42 are advantageously configured to present a chevron pattern 46 thereon, and may be of the type described in U.S. Pat. No. 3,733,063, which is incorporated herein by reference.

It will also be observed that each pack 32–40 presents an upper water entrance subface 48, and an opposed, lower, water exit subface 50. In like manner, each pack defines an upright, outboard air entrance subface 52 and an opposed, inboard, air exit subface 54. The respective subfaces 48–54 of each of the packs are substantially separate, and the water entrance subfaces of all of the packs cooperatively define the upper water entrance face of the overall film fill section 28. In like manner, the lower water exit subfaces 50 of the respective packs cooperatively define the lower water exit face for the overall film fill section; the air entrance subfaces 52 of the packs cooperatively define the total air entrance subface for the overall film fill sections; and the air exit subfaces of the packs jointly present the air exit face for the overall film fill section 28.

The fill assembly 26 is further provided with means for distribution of water and inhibiting exit airflow through the water entrance face of the overall film fill section. To this end, a plurality of slightly spaced apart (e.g., $\frac{3}{4}''$), elongated, synthetic resin, trough-like channels 56 are positioned above the water entrance subfaces 48 of the respective packs 32–40. Each channel member 56 includes an imperforate bottom wall 58, as well as a pair of spaced apart, upstanding sidewalls 60 provided with a series of V-shaped notches 62 therein. The function of the channel members 56 will be explained in detail hereinafter, but for the present it should be noted that the respective channel members 56 associated with each of the packs cooperatively presents the overall water distribution and airflow restricting structure forming a part of the complete fill assembly 26.

Referring again to FIG. 1, it will be seen that the respective film fill packs are located in a progressively inwardly staggered pattern and cooperatively cover the full height of the fill assembly. In the embodiment illustrated in FIG. 1, the packs are oriented such that the air exit subface 54 of each pack is inboard of the air entrance subface 52 of the next adjacent pack, such that the separate packs are disposed in an overlapping relationship one to the other.

The splash fill section 30 includes a plurality of elongated splash bars 64 of inverted, V-shaped configuration in cross-section (see FIG. 5). The bars are suspended by the usual hangers 66, and are oriented such that the longitudinal axes of the bars is in general alignment with the flow of air currents through the fill assembly. It will futher be observed that the splash bars substantially completely occupy the entire volume of the fill assembly not occupied by the film fill section 28.

Figure 2:
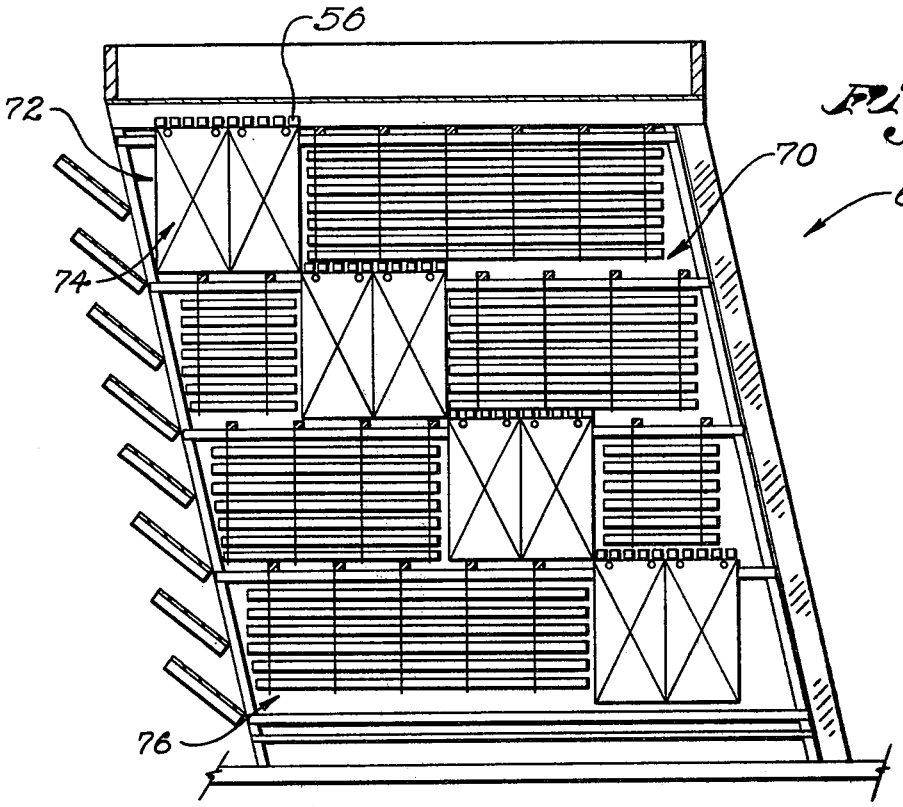
FIG. 2 is a view similar to that of FIG. 1, but illustrates another type of combination fill assembly in accordance with the invention, with the respective, staggered film fill packs being in point-to-point catercorner relationship to one another.

Turning now to FIG. 2, a tower 68 is illustrated having a combination fill assembly 70 in accordance with the invention. The tower 68 and assembly 70 are in most respects identical with tower 10 and fill assembly 26, and therefore only the points of difference will be discussed in detail. Specifically, the assembly 70 includes a film fill section 72 made up of four separate, inwardly staggered, identical film fill packs 74, as well as a splash bar fill section 76. In this embodiment however, the respective packs 74 are oriented in a point-to-point catercorner relationship, wherein the inboard air exit subface of each pack is in substantial vertical alignment with the air entrance subface of the next lower pack. By virtue of this pack orientation, the trough-like channel members 56 extend the full lateral extent of each pack, and not, as in the case of FIG. 1, only over the portion of each pack not covered by a superposed pack. In all other material respects, the tower 68 and fill assembly 70 are identical with tower 10 and fill assembly 26.

Figure 3:
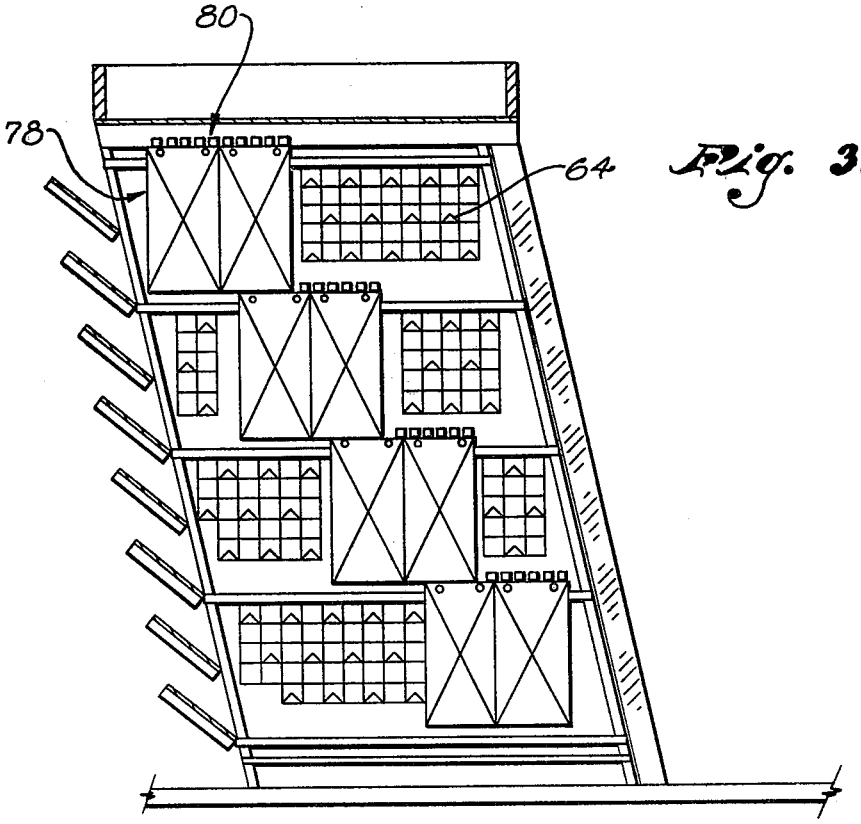
FIG. 3 is a view similar to that of FIG. 1, but illustrates the splash bar components of the fill assembly oriented with their longitudinal axes transverse to the direction of airflow through the fill assembly.

FIG. 3 illustrates yet another embodiment of the invention wherein a fill assembly 78 is provided. In this instance the film fill section 80 is identical with that described in connection with FIG. 1, and the splash section is different only in that the bars 64 comprising the same are oriented with their longitudinal axes transverse to the direction of airflow through the fill assembly.

FIGS. 6 and 7 illustrate another alternative, particularly in connection with the hot water distribution basin associated with the fill assembly. In particular, a basin 82 is illustrated in FIGS. 6 and 7, which is equipped with a plurality of water-dispersing nozzles 84 situated in appropriate apertures through the basin floor. The nozzles 84 are of the type illustrated and described in U.S. Pat. No. 3,617,036, incorporated by reference herein. The use of such nozzles can in many instances facilitate even water distribution for the underlying fill assembly.

FIG. 4 illustrates another embodiment of the invention wherein, when at least certain of the film fill packs are spaced laterally at the same vertical level in the overall fill assembly, bottom supported film fill spacer bundles are disposed between the side-by-side packs in the region. Specifically, in the FIG. 4 illustration, the space between respective side-by-side packs is covered by a section of auxiliary corrugated film fill sheets defining a water cooling spacer bundle supported by underlying girt structure as depicted and functioning to prevent hot water bypass downwardly through these areas without any cooling thereof. Exemplary film fill bundles useful for this purpose are shown for example in Japanese Utility Model Patent No. 31463/61 and U.S. Pat. No. 3,733,063. The grits supporting the film fill bundles serve to limit and restrict significant upward airflow through such bundles and air passage therethrough has primarily a horizontal direction component. These patents are incorporated by reference herein.

The use of fill assemblies in accordance with the invention, in the context of a crossflow cooling tower, will be apparent to those skilled in the art. However, by way of brief explanation, it will be understood that (referring to tower 10 of FIG. 1), volumes of initially hot water are pumped to basin 12, whereupon the water passes through the apertured basin floor 14 and onto the fill assembly 26. As the water descends through the fill assembly, it encounters and passes through, during a portion of this descent, one or more fill packs 32-40, and also certain of the splash bars 64. The ultimate effect of this travel is that the water is dispersed and thence cooled by currents of crossflowing, ambient-derived air drawn through the air inlet face 18 of tower 10.

As the water descends to a level to enter one of the fill packs, the water first encounters the open top channel members 56. These channel members, as noted above, serve to disperse water, and also to inhibit exit flow of air out the upper water entrance subfaces of the packs. Specifically, the water descending onto the members 56 impinges onto the imperforate bottom walls 58 thereof and begins to collect; the notches 62, however, allow such water to overflow laterally from the respective members and thence onto the underlying fill sheets 52 for film-air thermal interchange with the crossflowing cooling air currents.

The water leaving the respective packs 32–40 passes out the lower exit subfaces 50 thereof and, depending upon the portion of the pack in question, either onto splash bar 64 or through a portion of the next underlying pack. However, it will be observed that at some point during the descent of the water, it impinges upon the splash bars 64 for cooling in the section 30 of the overall fill assembly 26. This may occur either before entrance of the water into a film fill pack, or prior thereto. Ultimately however, the water in a cooled condition is collected within cold water basin 16.

It will be observed from the foregoing that the water entrance subface of each pack is in opposed relationship to the underlying water exit subface of the pack; moreover, the upright air entrance and air exit subfaces 52, 54 of the respective packs are likewise in opposed relationship. Thus, the four subfaces of each pack (and thereby the four faces of the overall film fill section 28 cooperatively defined thereby) are substantially separate, i.e., substantially no water passes into the packs through the air entrance and exit subfaces. By the same token, the construction of the respective packs, and the provision of the channel members 56 or other equivalent structure, assures that the inertia of crossflowing airflow is substantially maintained in order that "short circuiting" of cooling air by passage thereof through the water entrance subfaces 48 of the packs is restrained.

The rationale for placement of the packs 32–40 in their preferred, inwardly staggered orientation can best be explained as follows. Specifically, the crossflow evaporative cooling process within tower 10 is subject to the law of diminishing returns. For purposes of illustration, the process within a plane parallel to the airflow will be examined. For the combination fill, an incremental increase in fill in the air travel direction is less effective than any preceding increment, inasmuch as the cooling potential of the air is reduced as it passes through the fill. A similar statement can be made regarding increases in fill height, in that the last increment of fill added at the bottom contributes less cooling than any increment above it. This is because the cooling potential has decreased inasmuch as the temperature difference between the water and air has decreased. In the preferred combination fill assembly of the invention, however, maximum use is made of the more expensive film fill in the regions of the overall fill where it is most effective, i.e., where it has the greatest cooling potential.

For simplicity this will be explained as if each "cube" of fill has the same height and air travel dimensions, even though this is not true in reality. Consider the case wherein there are three increments of fill height and three increments thereof in the air travel direction. At the top, all of the water has the same temperature so that the greatest cooling potential is immediately adjacent the tower air inlet (where the air is coldest). This therefore locates the film fill in the uppermost and outboardmost "cube," and the remainder of the fill in the air travel direction would contain splash-type fill. At the second vertical level, the water falling from the uppermost and outermost film fill has been cooled significantly while the remainder of the water from the splash fill section has cooled much less. The latter results from the fact that the splash is less effective and because the air passing through it had previously picked up heat in the film fill cube. Hence at this second level the film fill cube is offset in the air travel direction so as to intercept a portion of the hotter water and to utilize air which has had a minimal amount of heat added in passing only through the splash fill situated beneath the upper film fill cube.

At each succeeding level, the film fill cube is offset inwardly in a similar manner. For the bottom level of fill the film fill cube would occupy the last increment of air travel. Thus, it will be seen why the arrangements illustrated in FIGS. 1–3, are preferred from the standpoint of cooling efficiency.

The film fill packs 32–40 depicted in FIG. 1 are made up of a series of side-by-side, spaced apart synthetic resin sheets of substantially rectangular configuration. In certain other cases, however, the pack-defining sheets can be in the configuration of a parallelogram, that is to say, with obliquely oriented upright margins. Such a construction could be employed, if desired, in order that the packs be designed to accommodate the characteristic water pullback associated with crossflow cooling towers. Even in this event, however, the faces would be substantially separate as noted above, inasmuch as little water would effectively impinge upon the air exit subfaces of the packs because of water pullback.

We claim:

1. A crossflow water cooling tower fill assembly for receiving and dispersing quantities of descending, initially hot water, and for causing currents of crossflowing, ambient-derived cooling air drawn through said fill assembly to come into crossflowing, intersecting, thermal interchange relationship to said descending water, said fill assembly comprising:

a film fill section having a series of spaced, opposed, face-to-face fill sheets which cooperatively present an upper water entrance face, an opposed, lower, water exit face, an outboard air entrance face and an opposed, inboard air exit face, said respective faces being substantially separate, said film fill section including a plurality of separate film fill packs each having a series of said spaced, opposed, face-to-face fill sheets;

means mounting said packs in a progressively inwardly staggered pattern with the uppermost pack of the section being the outermost pack, and the lowermost pack being the innermost pack, each of said packs presenting an upper water entrance subface, an opposed, lower water exit subface, an outboard air entrance subface, an opposed, inboard air exit subface, the respective subfaces of each pack being substantially separate, the water entrance subfaces of said packs cooperatively defining said upper water entrance face of the overall film fill section, the water exit subfaces of said packs cooperatively defining said lower water exit face of the overall film fill section, the air entrance subfaces of said packs cooperatively defining the outboard air entrance face of the overall film fill section, and the air exit subfaces of said packs cooperatively defining the inboard air exit face of the overall film fill section;

water distribution and airflow restricting means for dispersing water prior to entrance thereof into said film fill section through said water entrance face, and for inhibiting exit flow of air currents traveling through said section out of said upper water entrance face, said water distribution and airflow restricting means comprising individual water distributing and airflow restricting elements respectively disposed above corresponding water entrance subfaces for inhibiting exit flow of air currents traveling through the associated packs out of the upper water entrance subface thereof; and a splash fill section located in side-by-side relationship to said film fill section and including a plurality of splash bars for dispersing additional quantities of said descending water.

2. The fill assembly as set forth in claim 1, said film fill section extending substantially the full height of said fill assembly.

3. The fill assembly as set forth in claim 1, adjacent packs being oriented in a catercorner relationship to one another.

4. The fill assembly as set forth in claim 3, the air exit subface of each pack being inboard of the air entrance subface of the next underlying adjacent pack.

5. The fill assembly as set forth in claim 1, at least certain of said packs being in spaced side-by-side relationship and at the same vertical level within the assembly, there being auxiliary water cooling and vertical airflow restricting means disposed in the region between the packs.

6. The fill assembly as set forth in claim 1, said water distribution and airflow restricting means including a plurality of side-by-side, elongated water overflow troughs.

7. The fill assembly as set forth in claim 1, said sheets being substantially rectangular in configuration.

* * * * *